US006798310B2

(12) United States Patent
Wong et al.

(10) Patent No.: US 6,798,310 B2
(45) Date of Patent: Sep. 28, 2004

(54) COAXIAL DC BLOCK

(75) Inventors: Kenneth H. Wong, Santa Rosa, CA (US); James C. Liu, Santa Rosa, CA (US); James E. Tranchina, Forestville, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 1 day.

(21) Appl. No.: 10/337,748

(22) Filed: Jan. 7, 2003

(65) Prior Publication Data

US 2004/0130407 A1 Jul. 8, 2004

(51) Int. Cl.[7] ..... H01P 1/26; H01P 5/00
(52) U.S. Cl. ..... 333/24 C; 333/12
(58) Field of Search ..... 333/12, 24 C, 333/24 R, 206, 260; 361/328, 329

(56) References Cited

U.S. PATENT DOCUMENTS 2,516,529 A * 7/1950 Raymond ..... 333/32
3,617,607 A * 11/1971 Williams ..... 174/35 C
3,980,976 A * 9/1976 Tadama et al. ..... 333/206
4,399,419 A * 8/1983 Dobrovolny ..... 333/12
4,586,008 A * 4/1986 Raleigh ..... 333/19
5,276,415 A * 1/1994 Lewandowski et al. ..... 333/260
5,327,111 A * 7/1994 Gipprich ..... 333/260
6,496,353 B1 * 12/2002 Chio ..... 361/306.1

OTHER PUBLICATIONS

Gill, Ravinder, Bias Tee and DC Block Illuminate 65 GHz, Microwaves and RF, pp. 116–118 and 133 (Sep. 2001).

* cited by examiner

*Primary Examiner*—Robert Pascal
*Assistant Examiner*—Dean Takaoka

(57) ABSTRACT

A DC-block includes a capacitor incorporated into a conductor, such as a center conductor of a coaxial structure. The DC block provides low insertion loss at high frequencies, and a low cutoff frequency. The small physical size and high capacitance of the DC block provides for a high self-resonant frequency and ultra-broadband performance.

18 Claims, 5 Drawing Sheets

COAXIAL DC BLOCK

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to electronic devices and more particularly to a direct-current ("DC") blocking capacitor integrated into the center conductor of a coaxial transmission structure.

BACKGROUND OF THE INVENTION

Blocking capacitors (commonly called "DC blocks") are used in a variety of applications to couple alternating current ("AC") of sufficient frequency across the capacitor while blocking DC current Blocking capacitors have a cutoff frequency, below which AC is not efficiently coupled across the capacitor, and a self-resonant frequency that typically limits the upper frequency of operation. Generally, a lower cutoff frequency can be achieved with a greater capacitance, and a higher self-resonant frequency can be achieved with a physically smaller capacitor.

Blocking capacitors are incorporated in electronic circuits, such as at the input of an amplifier or mixer in a series configuration, to keep DC from damaging the circuit. Incorporating a conventional DC block in a packaged microcircuit typically involves die attaching one plate of a capacitor to the microcircuit and then wire-bonding or mesh-bonding the other plate of a capacitor to another portion of the packaged microcircuit, such as a feedthru pin. This increases assembly time and occupies additional room inside the packaged microcircuit. The conventional DC block often disrupts the transmission characteristics of the circuit, so compensating for the disruption by manipulating the wire-bond or mesh-bond, or by adding tuning elements, such as poly-iron, inside the packaged microcircuit, is employed, which increases the assembly time of the microcircuit.

Coaxial DC blocks incorporate a capacitor along the electrical path of the center conductor of a coaxial structure, such as a coaxial transmission line, a coaxial connector, or a coaxial feedthru. Coaxial DC blocks can be integrated into a packaged microcircuit, an external device, such as a connector, adaptor, or bias-T, or integrated into a port of a test instrument, such as a network analyzer, spectrum analyzer, or signal generator.

FIG. 1 is a simplified cross-section of a first prior-art coaxial DC block 10. A capacitor 12 is attached to the end face a first center conductor half 14 of a coaxial structure. A bellows 16 is held in a pocket 18 of a second center conductor half 14'. The bellows are electrically conductive and press against the metallized plate 13 of the capacitor 12. The other plate 11 of the capacitor is soldered or otherwise electrically and mechanically coupled to the first center conductor half 14. The capacitance of the capacitor is a function of the area of the plates of the capacitor, the distance between the plates, and the dielectric constant of the material 15 between the plates.

The bellows 16 approximate the diameter of the center conductor to maintain the characteristic impedance of the coaxial structure. Both center conductor halves 14, 14' must be supported to maintain contact (compression) and alignment. The gap that the bellows 16 occupies varies from assembly to assembly, and the bellows compensate for the manufacturing tolerance build-up of the other parts of the DC block by extending or compressing. The diameter of the capacitor 12 is less than or equal to the diameter of the center conductor, so if the center conductor is small the associated capacitor might have an undesirably low capacitance, resulting in a higher cutoff frequency.

The type of coaxial DC block illustrated in FIG. 1 can achieve good results if the cross-sectional area of the center conductor is sufficiently large or the intended operating frequency is limited. For example, the type of coaxial DC block illustrated in FIG. 1 can work well in an N-type coaxial connector because the center conductor is relatively large. In these N-type coaxial connectors the coaxial DC block can provide acceptable performance from about 10 MHz to about 18 GHz.

FIG. 2 is a simplified cross section of a second prior art coaxial DC block 20 that uses multiple capacitors. Two parallel-plate capacitors 22, 24 are held in a special clip 26 that mechanically supports the capacitors and electrically connects the outer plates 28, 30 of the capacitors to a first center conductor half 14. Axially resilient coaxial connections 32, 34 press against the clip 26 and the inner plates 36, 38 of the capacitors to create a solderless electrical connection with a second center conductor half 14'.

Unfortunately, the clip 26 and the capacitors 22, 24 extend relatively far beyond the circumference of the center conductor halves 14, 14'. Creating a discontinuity, such as a change in the diameter in the center conductor that disrupts the characteristic impedance, affects the transmission of high-frequency electrical signals through the coaxial DC block. These discontinuities are especially difficult to compensate for at millimeter frequencies. In addition, transmission of high-frequency signals through the compressive contacts are susceptible to shock and vibration as the parts move relative to each other. Additionally, both center conductor halves 14, 14' have to be firmly secured to maintain the compressive contact of the resilient coaxial connections against the capacitors.

BRIEF SUMMARY OF THE INVENTION

A DC block constructed according to the embodiments of the present invention includes a first conductor half and a second conductor half attached to plates of a capacitor extending along a longitudinal axis of the center conductor. The capacitor electrically couples alternating current between the first and second conductor halves and securely attaches the first conductor half to the second conductor half. In some embodiments, two or more capacitors are soldered to the first and second conductor halves in parallel, thus increasing the capacitance between the first and second conductor halves. In other embodiments, a radial capacitor, such as a cylindrical capacitor, is disposed within an outer conductor half.

A method according to an embodiment of the present invention fabricates a coaxial DC block from a center conductor of a coaxial structure, such as a center pin of a coaxial connector or feedthru. One or more parallel-plate capacitors are positioned in mounting slots formed in the center pin before the center pin is separated into first and second center conductor halves. This maintains alignment of the center conductor halves and length of the center pin during fabrication of the coaxial DC block.

DETAILED DESCRIPTION OF THE EMBODIMENTS

I. Exemplary DC Block Structures

Figure 3A:
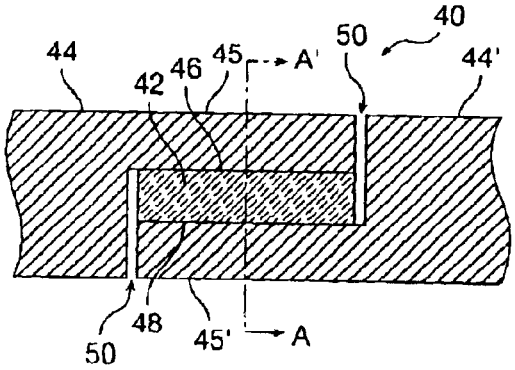
FIG. 3A shows a simplified cross sectional side view of a DC block according to an embodiment of the present invention.

FIG. 3A shows a simplified cross sectional side view of a DC block 40 according to an embodiment of the present invention. A capacitor 42 is held between conductor halves 44, 44'. In some embodiments, the DC block is formed in a center conductor of a coaxial structure to form a coaxial DC block. In a coaxial DC block, the conductor halves 44, 44' are center conductor halves. The remainder of the coaxial structure, namely the outer conductor and the dielectric spacer, are omitted for clarity of illustration and are familiar to those of ordinary skill in the art. In a particular example, a 400 pico-Farad ("pF") single-layer, parallel-plate rectangular capacitor that is 0.008 inches×0.025 inches×0.085 inches is mounted in a center pin of a coaxial structure. The center pin has a diameter of about 0.8 mm (0.031 inches), although the diameter, capacitor dimensions, and capacitance value are merely exemplary. In other embodiments, the DC block is alternatively formed in a non-coaxial conductor, such as a pin of a multi-pin connector.

The plates 46, 48 of the capacitor are typically soldered to the fully overlapping portions 45, 45' of the conductor halves, which at least partially overlap the plates of the capacitor and securely attach the capacitor in the DC block. In this embodiment the conductor halves 44, 44' include fully overlapping portions 45, 45' that extend in opposite directions along the axis of the conductor halves. Full overlap is not necessary; however, a large amount of overlap is generally desirable because the overlapping portions maintain the outer diameter of the conductor halves 44, 44', which is especially desirable if the conductor halves are center conductor halves of a coaxial structure. The capacitor couples alternating current ("AC") from one conductor half to the other, but blocks DC from flowing between the conductor halves.

Increasing the length of the capacitor along the axis of the conductor generally results in higher capacitance. A higher capacitance lowers the cutoff frequency of the DC block without significantly degrading high-frequency performance due to the small physical size of the capacitor. For example, a 0.008 inches×0.025 inches×0.085 inches 400 pF capacitor typically provides insertion loss less than 1 dB down to at least 45 MHz, but has a width less than the 0.8 mm (0.031 inches) diameter of the center pin, thereby maintaining continuity in the coaxial structure. Gaps 50 are optionally filled with epoxy or other non-conductive material (not shown) to provide additional strength, and to provide environmental protection for the ends of the center conductor halves.

The resonant frequency of a coaxial structure, such as a coaxial connector, depends on the dimensions of the center and outer conductors. For example, a 3.5 mm connector is generally understood to operate up to 26.5 GHz before a resonant mode might occur and a 1.85 mm connector is generally understood to operate up to about 67 GHz before a resonant mode might occur.

Figure 1:
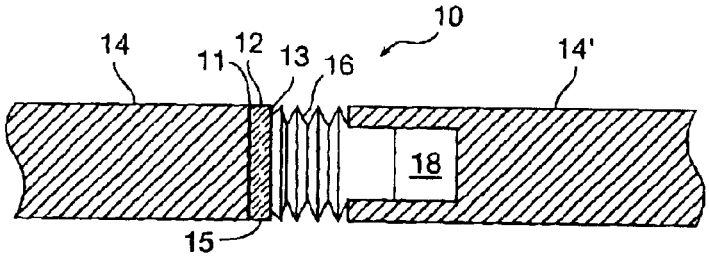
FIG. 1 (PRIOR ART)
FIG. 1 shows a simplified cross section of a first prior art coaxial DC block.
Figure 2:
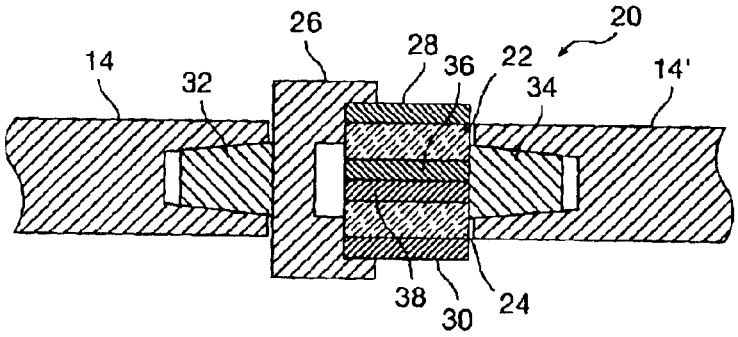
FIG. 2 (PRIOR ART)
FIG. 2 shows a simplified cross section of a second prior art coaxial DC block that uses multiple capacitors.

Using air as the dielectric between the center conductor and the outer conductor of a coaxial structure helps to avoid resonate modes because a resonant mode is more likely to occur if there is solid material between the center and outer conductors. The conventional coaxial DC blocks shown in FIGS. 1 and 2 use solid material between the center and outer conductors to maintain compressive contact of the center conductor with the capacitors. Coaxial DC blocks constructed according to embodiments of the present invention avoid using solid material between the center and outer conductors to maintain a compressive contact because the center conductor halves are attached to the capacitor.

Some embodiments of the present invention use capacitors that have a self-resonant frequency above the resonant mode frequency of a coaxial structure. For example, a 400 pF capacitor with a self-resonant frequency above 67 GHz is mounted in an 0.8 mm center pin of a 1.85 mm connector to provide a coaxial DC block. Typically, capacitors are chosen to have a self-resonant frequency that does not limit the high-frequency operation of the coaxial structure.

Figure 3B:
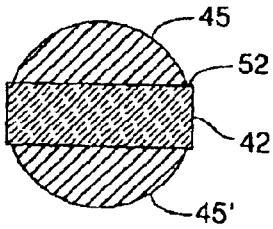
FIG. 3B shows a simplified cross sectional end view of the DC block shown in FIG. 3A.

FIG. 3B shows a simplified cross sectional end view of the DC block 40 shown in FIG. 3A taken along the section line A–A'. The capacitor 42 between the fully overlapping portions 45, 45' of the conductor halves has a slight overhang 52 at a corner of the capacitor, but has a width not greater than the diameter of the conductor halves. Alternatively, the capacitor may be slightly undercut from the sides of the conductor. If the DC block is used in a coaxial structure, the acceptable amount of overhang depends on the desired electrical performance of the coaxial structure. Generally, more overhang is tolerable in larger coaxial structures.

Figure 4A:
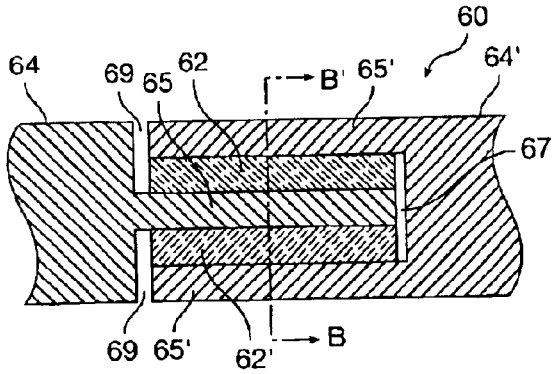
FIG. 4A shows a simplified cross sectional side view of a DC block using multiple capacitors, according to another embodiment of the present invention.

FIG. 4A shows a simplified cross sectional side view of a DC block 60 using multiple capacitors, according to another embodiment of the present invention. Two capacitors 62, 62' are sandwiched between overlapping portions 65, 65' of conductor halves 64, 64'.

The two capacitors 62, 62' are single-layer, parallel-plate capacitors, doubling the total capacitance between the conductor halves 64, 64' compared to a DC block using a single capacitor of similar area and thickness constructed in accordance with FIG. 3A. For example, if each capacitor 62, 62' is the 0.008 inches×0.025 inches×0.085 inches 400 pF single-layer, parallel-plate rectangular capacitor discussed above (see FIG. 3A, ref. num. 42), then the total capacitance between the conductor halves 64, 64' is 800 pF. The gaps 67, 69 shown in FIG. 4A break the DC current path between the conductor halves 64, 64'. The size and location of these gaps is relatively easy to control, and it is relatively easy to compensate for impedance mismatch at millimeter frequencies that arises from these gaps using standard tuning techniques when the DC block is used in a coaxial structure.

Figure 4B:
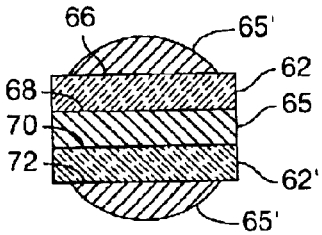
FIG. 4B shows a simplified cross sectional end view of the DC block shown in FIG. 4A.

FIG. 4B shows a simplified cross sectional end view of the DC block 60 shown in FIG. 4A taken along the section line B–B'. The parallel-plate capacitors 62, 62' are typically soldered to the overlapping portions 65, 65' of the center conductor halves at solder joints 66, 68, 70, 72. Appropriate solder could be a hard or soft solder, or compounds generally known as brazes or eutectics. Conductive adhesives such as silver epoxy or gold epoxy are alternatively used to conductively attach the overlapping portions 65, 65' of the conductor halves to the capacitors 62, 62'.

Figure 5A:
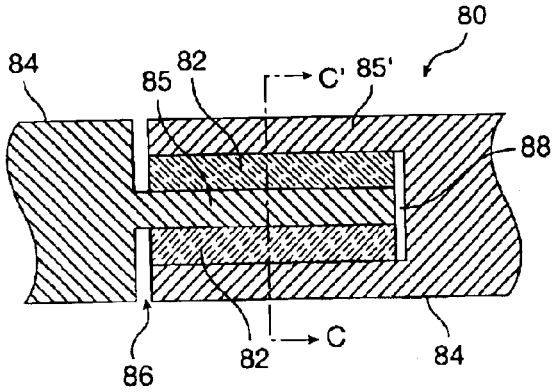
FIG. 5A shows a simplified cross sectional side view of a DC block using a radial capacitor, according to another embodiment of the present invention.

FIG. 5A shows a simplified cross sectional side view of a DC block 80 using a radial capacitor 82, according to another embodiment of the present invention. The radial capacitor 82 is supported by an inner overlapping portion 85 of a first conductor half 84 and an outer overlapping portion 85' of a second conductor half 84'. The overlapping portions 85, 85' are soldered to the inner and outer plates (not shown separately for simplicity of illustration) of the radial capacitor.

The radial capacitor is typically a pre-made cylindrical or cup-shaped capacitor. Alternatively, the dielectric material of the radial capacitor could be sputtered, fired, or coated onto one or both of the portions of the conductor halves that overlap. The outer surface of the sputtered, fired, or coated dielectric layer could be ground or otherwise trimmed to fit the mating conductor half.

A DC block of FIG. 5A maintains an outer diameter of the conductor, which is especially desirable if the DC block is used in a coaxial structure. However, the two conductor halves are fabricated as separate pieces, and alignment and straightness are more difficult to control compared to DC blocks fabricated out of a single center conductor. When a coaxial DC block of FIG. 5A is placed in a coaxial structure having a solid dielectric material between the center and outer conductors, the solid dielectric material may provide additional straightness, alignment, and support for the coaxial DC block, even though the use of solid dielectric material may promote resonant modes. The constant outer diameter of a coaxial DC block of FIG. 5A facilitates its use in a coaxial transmission structure with solid dielectric material.

Figure 5B:
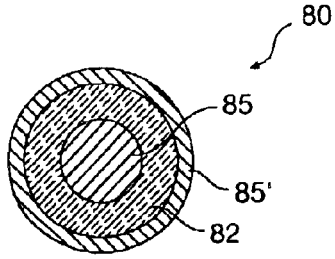
FIG. 5B shows a simplified cross sectional end view of the DC block shown in FIG. 5A.

FIG. 5B shows a simplified cross sectional end view of the coaxial DC block 80 shown in FIG. 5A taken along the section line C–C' and shows the radial capacitor 82 soldered or otherwise attached to the overlapping portions 85, 85' of the inner and outer conductor halves.

II. Exemplary Manufacturing Sequence

FIGS. 6A–6E illustrate a manufacturing sequence for the DC block shown in FIGS. 4A and 4B, according to an embodiment of the present invention. Commercially available parallel-plate capacitors 62, 62' are integrated into a center pin 100 of a coaxial connector or package feedthru. A center pin 100 with integrated capacitors 62, 62' enables a coaxial DC block 110 that suitably replaces a conventional center pin included in the coaxial connector or package feedthru. The coaxial DC block is robust, and minimizes the influence of mechanical shock on the performance of the coaxial connector or package feedthru.

Figure 6A:
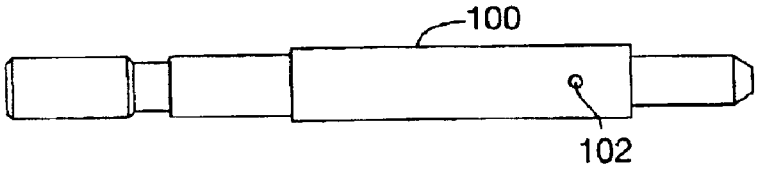
FIGS. 6A–6E illustrate a manufacturing sequence for the DC block shown in FIGS. 4A and 4B, according to an embodiment of the present invention.

FIG. 6A is a simplified side view of a center pin 100 used as a center conductor in a coaxial connector, such as a 1.85 mm coaxial connector. An optional starting hole 102 for electronic-discharge machining ("EDM") is formed through the center pin 100.

This center pin 100 is about 8.7 mm long and has a maximum diameter of about 0.8 mm. This type of center pin is merely exemplary, and other center pins or center conductors may be used, whether incorporated into a coaxial connector, coaxial feedthru, coaxial adaptor, coaxial transmission line, or other coaxial structure.

Figure 6B:
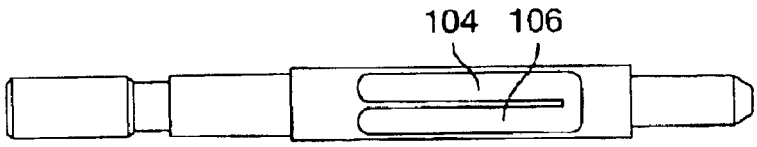

FIG. 6B shows capacitor-mounting slots 104, 106 formed in the center pin by EDM, and center pin is then typically gold-plated and heat treated. Parallel-plate capacitors will be soldered into the capacitor mounting slots 104, 106. The capacitor-mounting slots 104, 106 are made taller than the intended capacitors are thick, to account for the thickness of the gold plating and of the solder used to attach the capacitors to the center pin. The capacitor-mounting slots 104, 106 are also typically longer than the intended capacitors to facilitate separation of the center pin to provide DC isolation between the center conductor halves, and to account for variation in the length of the capacitors arising from manufacturing tolerances.

Figure 6C:
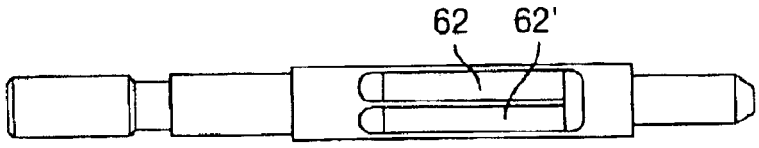

FIG. 6C shows parallel-plate capacitors 62, 62' soldered to the center pin. The parallel-plate capacitors 62, 62' are essentially identical, or alternatively have different sizes or capacitances. A solder paste re-flow technique is used, but other soldering, brazing, or conductive adhesive techniques are alternatively used. The center pin remains straight and relatively rigid during these manufacturing steps because it is a single piece. The center pin also retains its length, which is desirable when the coaxial DC block is used in a high-frequency coaxial connector because a longer or shorter center pin could distort a mating center conductor or create a discontinuity in the characteristic impedance of the high-frequency coaxial connector.

Figure 6D:
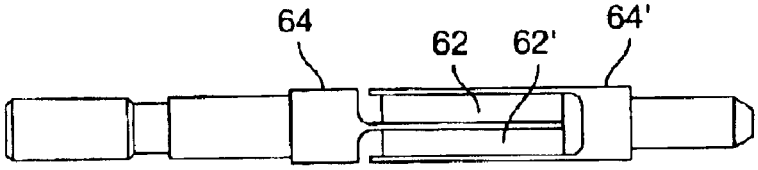

FIG. 6D shows the coaxial DC block with the center pin separated into center conductor halves 64, 64', thus breaking the DC path between the center conductor halves. EDM., milling, sawing, etching, or other processes are alternatively used to separate the center pin 100 into center conductor halves 64, 64', or to form the capacitor-mounting slots 104, 106. The capacitors 62, 62' are in a parallel configuration between the center conductor halves 64, 64'. Thus, the capacitance between the center conductor halves 64, 64' is the sum of the capacitance of the capacitors 62, 62'.

Figure 6E:
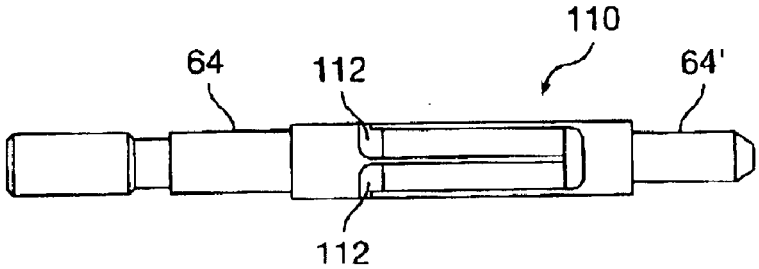

FIG. 6E shows a coaxial DC block 110 with epoxy 112 filling the gaps between the center conductor halves 64, 64'. This protects the unplated surfaces of the center conductor halves 64, 64' that were exposed when the center pin was separated into the center conductor halves (see FIGS. 6C, 6D), and strengthens the thin section of the center conductor half 64. Other non-conductive filler materials are alternatively used, such as a thermoplastic resin or other thermosetting resin.

Figure 7:
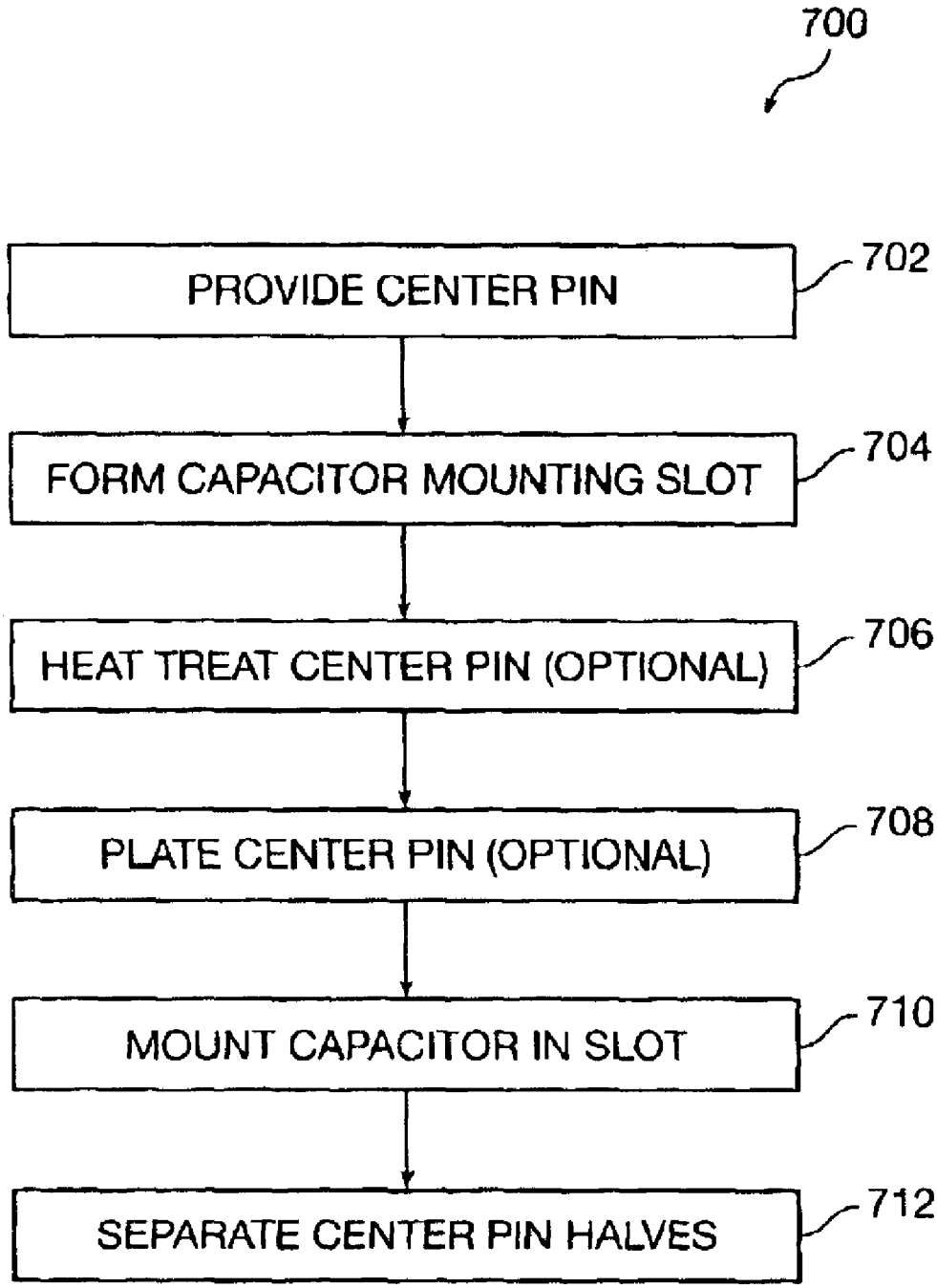
FIG. 7 is a simplified flow chart of a method of manufacturing the DC block in accordance with the manufacturing sequence illustrated in FIGS. 6A–6E.

FIG. 7 is a simplified flow chart of a method 700 of manufacturing a the DC block in accordance with the manufacturing sequence illustrated in FIGS. 6A–6E. A center pin (see FIG. 6A, ref. num. 100) is provided (step 702) and at least one capacitor-mounting slot (see FIG. 6B, ref. nums. 104, 106) is formed in the center pin (step 704). The slotted center pin is optionally beat treated (step 706) and plated (step 708), typically with gold. A parallel-plate capacitor (see FIG. 6C, ref. nums. 62, 62') is mounted into the at least one capacitor-mounting slot (step 710), typically by soldering, and the center pin is separated into center conductor halves (see FIG. 6D, ref. nums. 64, 64')(step 712) joined through the capacitor. The capacitor blocks DC and, above a cutoff frequency, couples AC from one center conductor half to the other. The capacitor also holds the center conductor halves together. A portion of each center conductor half at least partially overlaps a plate of the capacitor.

III. Experimental Results

Figure 8A:
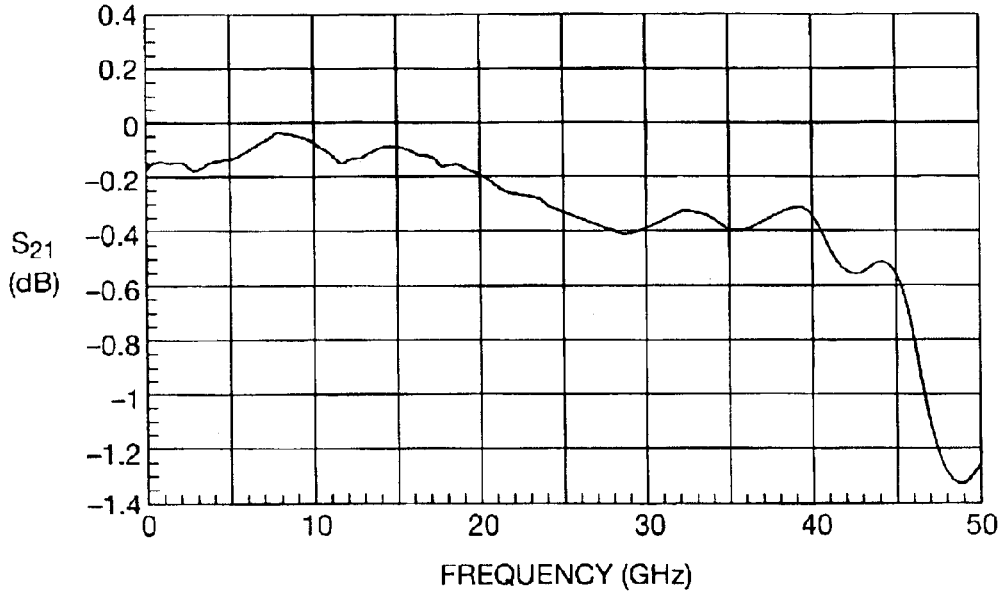
FIG. 8A shows a transmission frequency response for the DC block of FIGS. 4A and 4B.

FIG. 8A shows a transmission frequency response for the DC block 60 of FIGS. 4A and 4B. Two capacitors about 8 mils thick and having a capacitance of 400 pF were soldered in a center pin of a 1.85 mm connector to fabricate a prototype coaxial DC block. The transmission frequency response of the prototype coaxial DC block was measured in a 50-ohm test system, indicated by the scattering parameter $S_{21}$ plot The plot is calibrated to shown the difference in transmission characteristic between a 1.85 mm connector with a conventional center pin and the 1.85 mm connector with the prototype coaxial DC block 60. The prototype coaxial DC block provided insertion loss less than 0.2 dB as low as 10 MHz, and insertion loss of less than 0.6 dB up to 45 GHz.

Figure 8B:
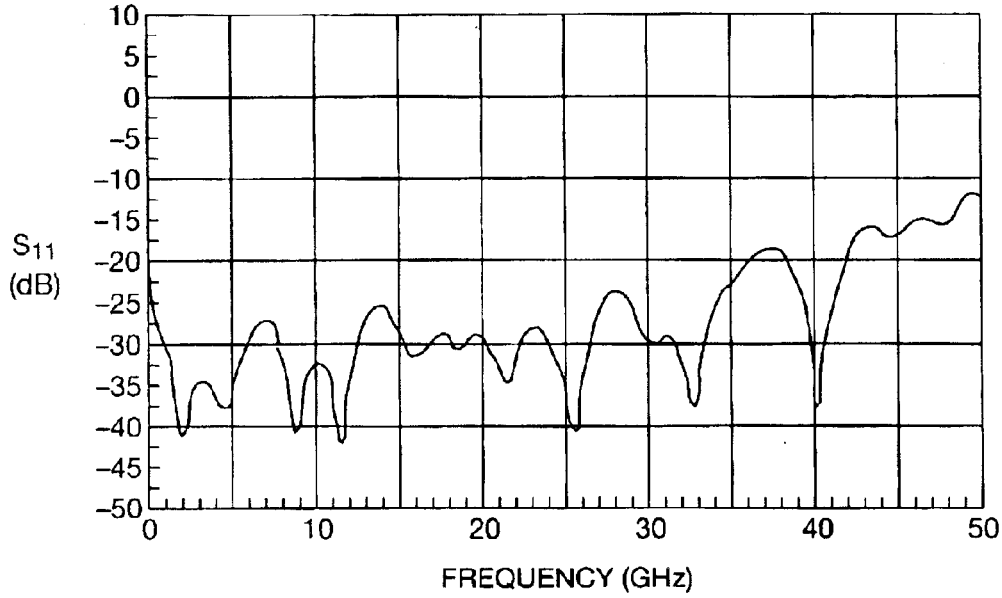
FIG. 8B shows a reflection frequency response for the DC block of FIGS. 4A and 4B.

FIG. 8B shows reflection frequency response for the DC block 60 of FIGS. 4A and 4B, indicated by the scattering parameter $S_{11}$ plot. The plotted reflection frequency response is calibrated to show the difference in reflection characteristic between a 1.85 mm connector with a convention center pin and the coaxial DC block. The $S_{11}$ is less than −20 dB from 0–35 GHz, and remains less than −12 dB all the way up to 50 GHz.

FIGS. 8A and 8B indicate that the DC block has broadband performance and is suitably integrated into a variety of structures and products. If such a DC block is incorporated into a compensated circuit, even better electrical performance is expected.

Relatively thick capacitors are accommodated in DC blocks 40, 60. Thick capacitors are significantly more robust and easier to handle than thin-film "chip" capacitors often used on hybrid microcircuits. A wide range of off-the-shelf capacitors can be incorporated into DC blocks constructed according to embodiments of the present invention.

While the preferred embodiments of the present invention have been illustrated in detail, it should be apparent that modifications and adaptations to these embodiments might occur to one skilled in the art without departing from the scope of the present invention as set forth in the following claims.

What is claimed is:

1. A direct-current block comprising:

a first conductor half with a first overlapping portion extending along an axis;

a second conductor half with a second overlapping portion extending oppositely along the axis; and a capacitor disposed between the first overlapping portion and the second overlapping portion and having a first plate electrically coupled to the first conductor half, and a second plate electrically coupled to the second conductor half.

2. The direct-current block of claim 1 wherein the first conductor half is a first center conductor half and the second conductor half is a second center conductor half and the direct-current block is integrated into a coaxial structure.

3. The direct-current block of claim 2 wherein the first center conductor half and the second center conductor half are formed from a center pin of a coaxial connector.

4. The direct-current block of claim 2 wherein the coaxial structure has a resonant mode frequency and the capacitor has a self-resonant frequency greater than the resonant mode frequency.

5. The direct-current block of claim 1 wherein the first plate is attached to the first conductor half with solder and the second plate is attached to the second conductor half with solder.

6. The direct-current block of claim 1 wherein the capacitor has capacitance of at least 400 pico-Farads.

7. The direct-current block of claim 1 wherein the first conductor half and the second conductor half have a diameter and wherein the capacitor has a width not greater than the diameter.

8. The direct-current block of claim 7 further comprising:

a second capacitor having a third plate attached and electrically coupled to the first overlapping portion, and a fourth plate attached and electrically coupled to the second overlapping portion.

9. The direct-current block of claim 8 wherein the capacitor has a first capacitance and the second capacitor has a second capacitance, the first capacitance being different from the second capacitance.

10. The direct-current block of claim 8 wherein the capacitor and the second capacitor provide a capacitance between the first conductor half and the second conductor half of at least 400 pico-Farads.

11. The direct-current block of claim 1 wherein the capacitor is a cylindrical capacitor.

12. The direct-current block of claim 11 wherein the cylindrical capacitor is formed on at least one of the first overlapping portion and the second overlapping portion.

13. The direct-current block of claim 11 wherein the second conductor half has an outer diameter and the cylindrical capacitor is disposed within the outer diameter.

14. A direct-current block comprising:

a first center conductor half extending along an axis and having a first overlapping portion;

a second center conductor half extending along the axis and having a second overlapping portion; and a first capacitor having a first plate soldered to the first overlapping portion, and a second plate soldered to the second overlapping portion.

15. The direct-current block of claim 14 further comprising:

a second capacitor having a third plate soldered to the first overlapping portion, and a fourth plate soldered to the second overlapping portion.

16. The direct-current block of claim 15 wherein the first capacitor and the second capacitor provide a capacitance between the first center conductor half and the second center conductor half of at least 400 pico-Farads.

17. The direct-current block of claim 14 wherein the first center conductor half and the second center conductor half have a diameter and wherein the capacitor has a width not greater than the diameter.

18. The direct-current block of claim 14 wherein the direct-current block is integrated into a coaxial structure having a resonant mode frequency and the capacitor has a self-resonant frequency greater than the resonant mode frequency.

* * * * *